US006325558B1

(12) United States Patent
Robinson

(10) Patent No.: US 6,325,558 B1
(45) Date of Patent: Dec. 4, 2001

(54) TEAR BAR FOR A THERMAL PRINTER MECHANISM

(75) Inventor: Carl Wesley Robinson, Charlotte, NC (US)

(73) Assignee: XAC Automation Corporation, Hsinchu (TW)

( * ) Notice: Subject to any disclaimer, the term of this patent is extended or adjusted under 35 U.S.C. 154(b) by 0 days.

(21) Appl. No.: 09/695,309

(22) Filed: Oct. 25, 2000

(51) Int. Cl.[7] ..... B41J 11/26

(52) U.S. Cl. ..... 400/621; 400/693; 225/39; 225/42; 225/91

(58) Field of Search ..... 400/621, 693; 225/91, 39, 42

(56) References Cited

U.S. PATENT DOCUMENTS 4,619,538 * 10/1986 Patterson ..... 400/621
5,758,559 * 6/1998 Capitao, Jr. et al. ..... 83/614
5,772,094 * 6/1998 Kaiser et al. ..... 225/91
5,806,993 * 9/1998 Petterutti et al. ..... 400/88
5,984,158 * 11/1999 Frank ..... 225/91

* cited by examiner

*Primary Examiner*—John S. Hilten
*Assistant Examiner*—Marvin P. Crenshaw
(74) *Attorney, Agent, or Firm*—Sughrue, Mion, Zinn, Macpeak & Seas, PLLC

(57) ABSTRACT

Disclosed is a tear bar for a thermal printer mechanism, the thermal printer mechanism including at least a thermal head that is housed in a device housing defining an interior space with a base and surrounding walls and being formed with a window next to one of the surrounding walls, the tear bar comprising: a body portion having a first longitudinal edge and a second longitudinal edge opposing the first longitudinal edge; a tear portion extending along the first longitudinal edge at a first angle with respect to the body portion; a support portion extending along the second longitudinal edge at a second angle with respect to the body portion in a direction substantially opposing the tear portion; and a retaining device formed at the support portion; whereby when the body portion rests against the base juxtaposed the window, a channel space is formed between the support portion and the surrounding wall for retaining the thermal printer mechanism therein.

10 Claims, 5 Drawing Sheets

TEAR BAR FOR A THERMAL PRINTER MECHANISM

FIELD OF INVENTION

The present invention relates to a tear bar for a compact printer mechanism, for example, for use within transaction terminals or handheld devices used in point-of-sale (POS) systems and relates, more particularly, to a device comprising a tear bar that features paper tearing effect while, at the same, facilitates mounting of a thermal printer mechanism into a housing of the device without any additional screws or any other fasteners.

BACKGROUND OF INVENTION

Printers used in point-of-sale (POS) systems generally print to rolled paper as the recording medium using a thermal head or other type of print head, and comprise a tear bar that allows the user to tear the paper along continuous, serrated teeth formed on the tear bar to obtain a sales receipt that can be handed to the customer.

In the past, the thermal printer mechanism and the tear bar are components that need to be individually mounted within the housing of a device. Though such an approach is widely known, procedures in assembling such components take time and add expense.

It is thus needed to develop a new approach for mounting the thermal printer mechanism and the tear bar without using any additional screws or any other fasteners so as to provide a quick and inexpensive assembly without affecting the original functions of the tear bar and the thermal printer mechanism.

SUMMARY OF INVENTION

The object of the present invention is to provide a tar bar that features paper tearing effect while, at the same, facilitates mounting of a thermal printer mechanism into a housing of a device without any additional screws or any other fasteners.

It is a further object of this invention to provide a quick, compact and inexpensive assembly of the thermal printer mechanism into the housing of the device.

To achieve the above objects, disclosed is a tear bar for a thermal printer mechanism, the thermal printer mechanism including at least a thermal head, that is housed in a device housing defining an interior space with a base and surrounding walls and being formed with a window next to one of the surrounding walls, the tear bar comprising: a body portion; a tear portion extending from the body portion; a support portion extending from the body portion in a direction substantially opposing the tear portion; and a retaining device formed at the support portion.

Further objects and advantages of the present invention will become more fully understood from the detailed description of the preferred embodiments given below in conjunction with the accompanying drawings, wherein:

DETAILED DESCRIPTIONS OF EMBODIMENTS

Figure 1:
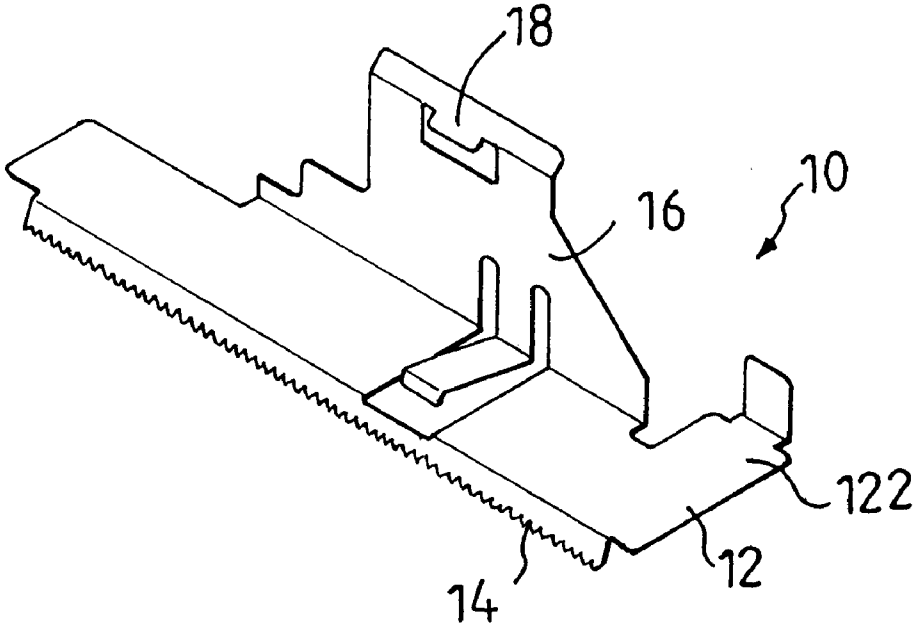
FIG. 1 a perspective view showing a tear bar of this invention.
Figure 2:
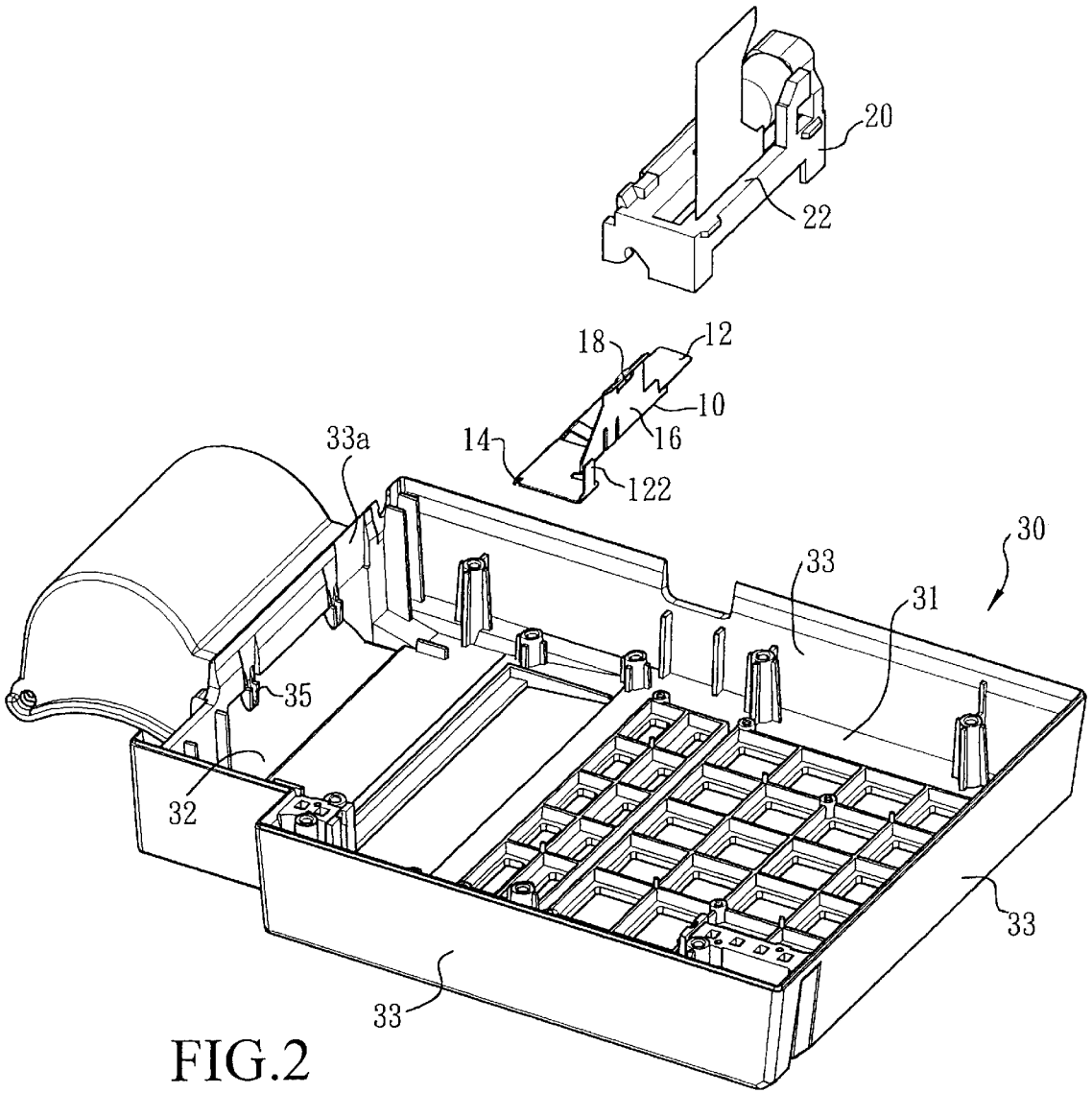
FIG. 2 is an exploded, perspective view showing the device housing, the tear bar, and the thermal printer mechanism.
Figure 3:
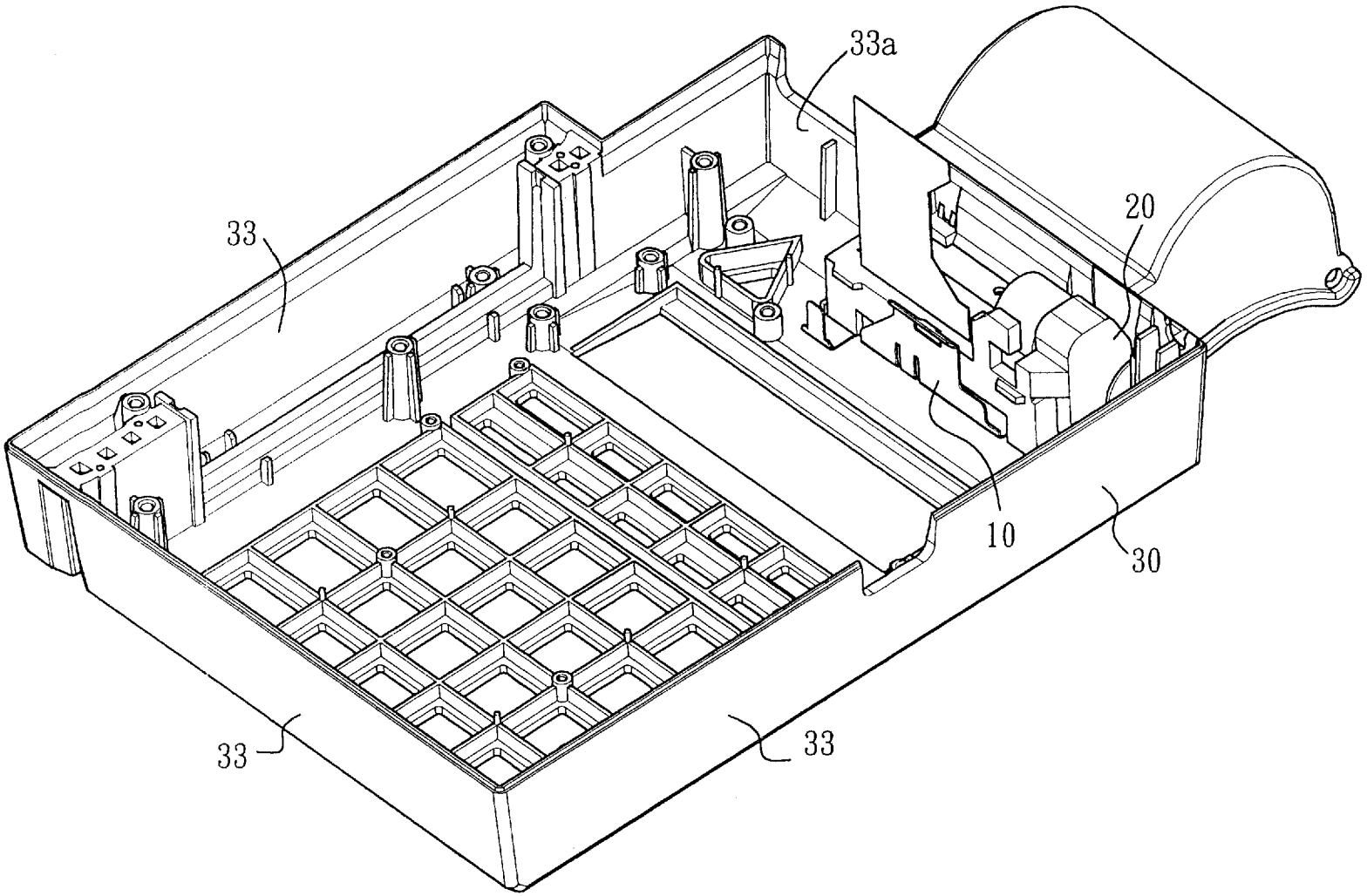
FIG. 3 is an assembled, perspective view showing the final assembly state of the tear bar and the thermal printer mechanism within the device housing.

Referring to FIG. 1, a tear bar 10 of this invention is shown in its perspective view. As shown in FIG. 2 and 3, the tear bar 10 is generally for use with a thermal printer mechanism. The thermal printer mechanism 20 includes, among other components (not shown), a thermal head and is housed in a device housing 30 defining an interior space with a base 21 and surrounding walls 33 and being formed with a window 32 next to one of the surrounding walls, designated as 33*a*.

Returning to FIG. 1, the tear bar 10 comprises: a body portion 12, a tear portion 14, a support portion 16, and a retaining device 18.

The body portion 12 has a first longitudinal edge and a second longitudinal edge opposing the first longitudinal edge.

Figure 4:
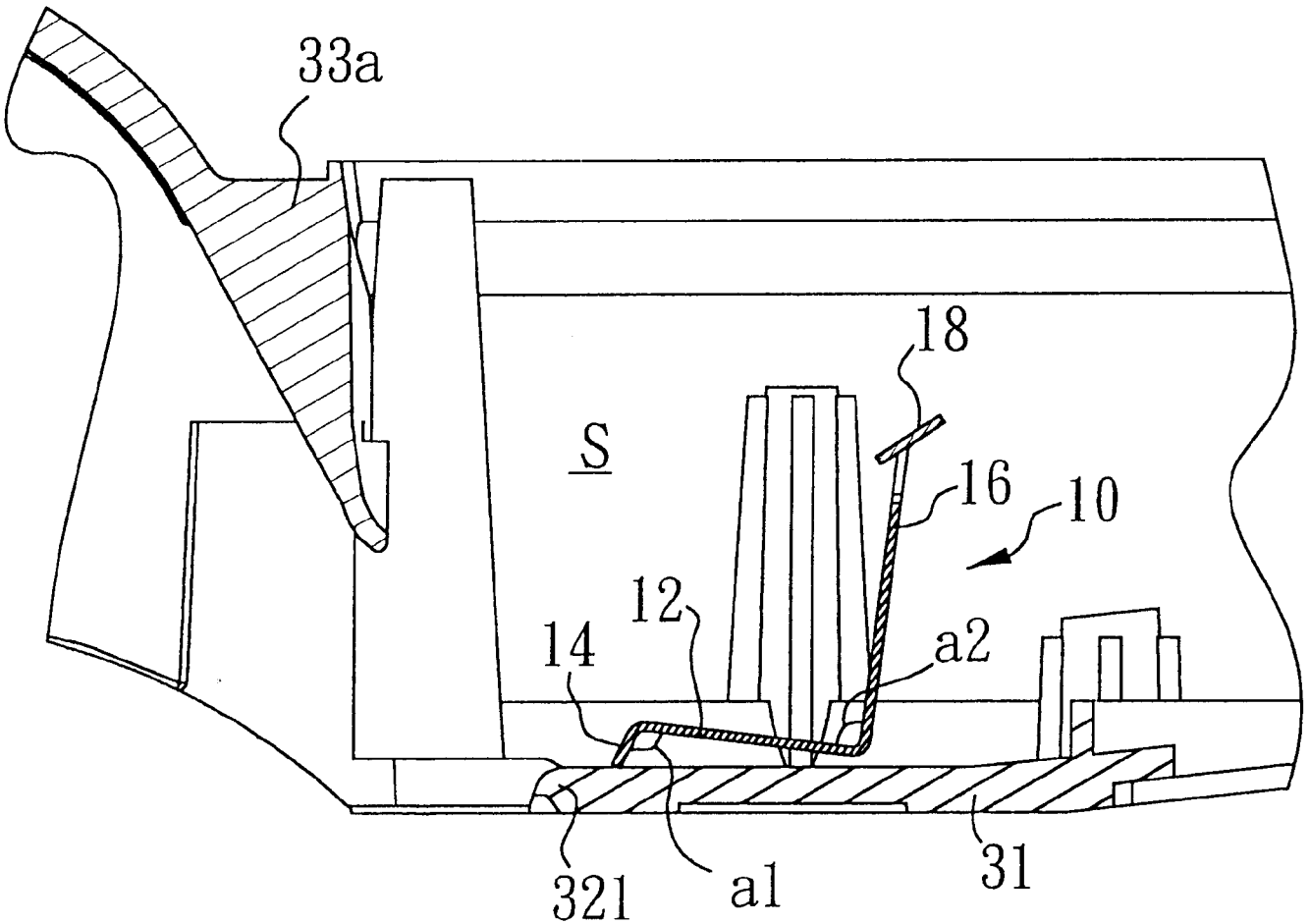
FIG. 4 is a cross-sectional view showing the relationship between the tear bar and the device housing during the assembling processes.

As best seen in FIG. 4, the tear portion 14 extends along the first longitudinal edge at a first angle a1 with respect to the body portion 12. The tear portion 14 is formed with continuous, serrated teeth as conventional tear bars such that paper running across the teeth may be easily torn away from the rolled paper.

The support portion 16 extends along the second longitudinal edge at a second angle a2 with respect to the body portion 12 in a direction substantially opposing the tear portion 12. The retaining device 18 is formed at the support portion 16. As shown in FIG. 4, the support portion 16 preferably forms a 90-degree angle a2 with respect to the body portion 12.

It is known that the tear bar 10 is best an integral piece made of resilient materials, and made of metallic materials by stamping. A grounding tail 122 may further extend from the body portion 12 to dissipate static electricity from the printer mechanism.

While assembling the tear bar 10 of this invention into the device housing 30, the body portion 12 is first set to rest against the base 31 juxtaposed the window 32, as shown in FIG. 4, such that a channel like space S is formed between the support portion 16 of the tear bar 10 and the surrounding wall 33*a*.

The thermal printer mechanism 20 is then inserted between the channel space S; a front end of the thermal printer mechanism 20 is then inserted through the window 32. After the thermal printer mechanism 20 is in place, the tear bar 10 is pushed towards the surrounding wall 33*a* subjecting the tear portion 12 to extend out of the window 32, as shown in FIG. 5.

The retaining de vice 18 then retains the thermal printer mechanism 20 between the support portion 18 and the surrounding wall 33*a*. The retaining device 18 may take on many designs to suit the configuration of the thermal printer mechanism 20 so long as the retaining device 18 is able to hold the thermal printer mechanism 20 in place.

In the this embodiment, the retaining device 18 includes a tab 182 extending from a top side of the support portion 16 towards the body portion 12 such that the tab 182 may urge against a step 22 formed at a rear end of the thermal printer mechanism 20. A slant surface may be formed at the step 22 to allow easy insertion of the thermal printer mechanism 20 into channel spaces; other similar measures in the a art may also be adopted.

Figure 5:
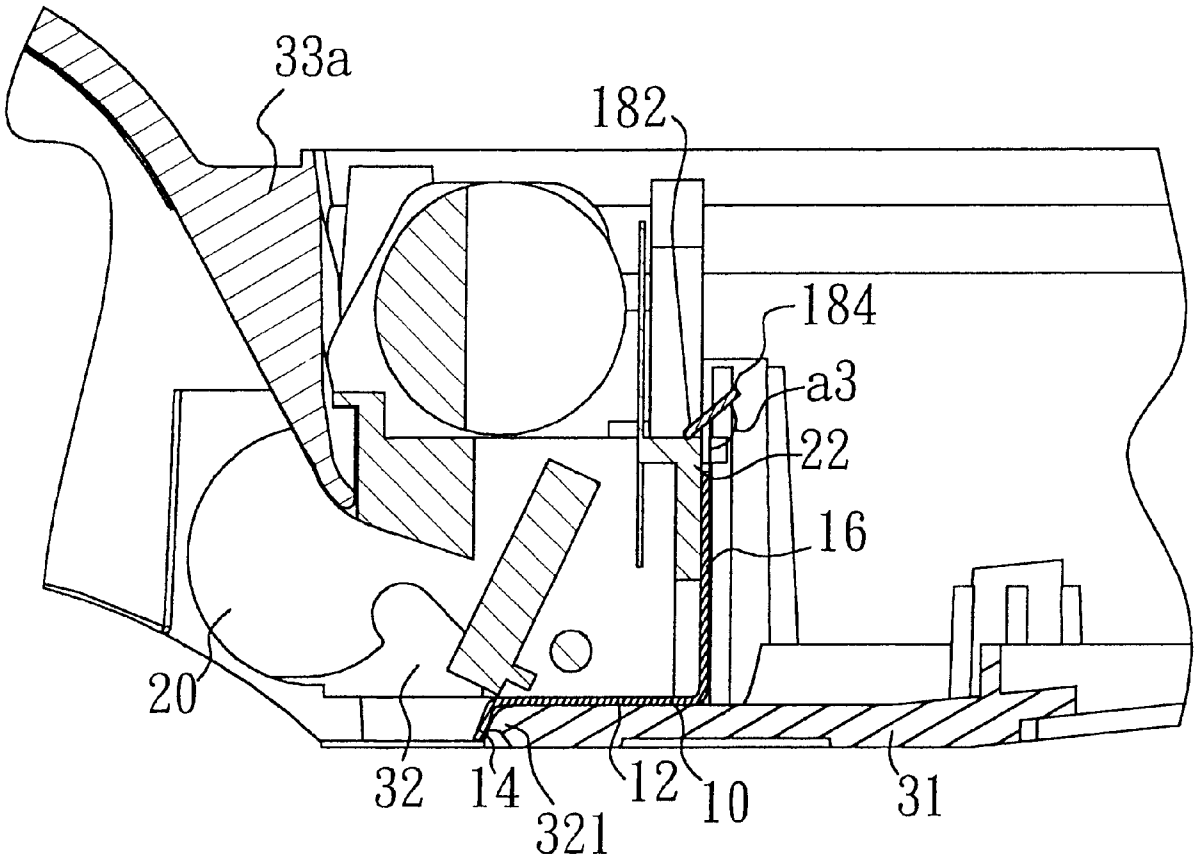
FIG. 5 is a cross-sectional view showing the relationship among the tear bar, the thermal printer mechanism, and the device housing after assembly.

As shown in FIGS. 4 and 5, after the thermal printer mechanism 20 is inserted into the channel space S, the support portion 16 of the tear bar 10 urges the thermal printer mechanism 20 towards the surrounding wall 33*a* and the base 31, such that the tear portion 14 is rested against a window edge 321 (FIG. 5). Under such a state, the thermal printer mechanism 20 is refrained from any movement unless the retaining means 18 no longer retains unto the step 22 of the thermal printer mechanism 20.

In other words, in order to move the thermal printer mechanism 20 or the tear bar 10, the retaining device 18 must be forced to pull away from the thermal printer mechanism 20 so as to allow surrounding movement of the thermal printer mechanism 20. Such a force can only be generated by revealing the interior of the housing 30, which interior is generally not accessible to the user in the points-of-sale (POS). In other words, in order to remove the thermal printer mechanism, the interior of the housing 30 must be exposed.

To facilitate removal of the thermal printer mechanism 20, when circumstances arise, a grip 184 may further be provided to extend at a third angle a3 from the top side of the support portion 16, as shown in FIG. 5, to allow easy gripping and pulling of the support portion 16.

As shown in FIG. 2, to further facilitate alignment of the tear bar 10, the housing 30 may be formed with alignments 34 on the base 31 next to the window 32. Alignment of the thermal printer mechanism 20 may also be accomplished by providing two claps 35 extending from the surrounding wall 33*a* for aligning with notches (not shown) formed on corresponding locations of the thermal printer mechanism 20.

As described above, the present invention provides a tear bar that features paper tearing effect while, at the same, facilitates mounting of a thermal printer mechanism into a housing of the printer without any additional screws or any other fasteners, such that the assembling processes and manufacturing cost of the thermal printer may be further reduced.

Aforementioned explanation is directed to the description of the preferred embodiment according to the present invention. Various changes and implementations can be made by those skilled in the art without departing from the technical concept of the present invention. Since the present invention is not limited to the specific details described in connection with the preferred embodiment except those that may be within the scope of the appended claims, changes to certain features of the preferred embodiment without altering the overall basic function of the invention are contemplated.

What is claimed is:

1. A tear bar for a thermal printer mechanism, the thermal printer mechanism including at least a thermal head, that is housed in a device housing defining an interior space with a base and surrounding walls and being formed with a window next to one of the surrounding walls, the tear bar comprising:

a body portion having a first longitudinal edge and a second longitudinal edge opposing the first longitudinal edge;

a tear portion extending along the first longitudinal edge at a first angle with respect to the body portion;

a support portion extending along the second longitudinal edge at a second angle with respect to the body portion in a direction substantially opposing the tear portion; and a retaining device formed at the support portion;

whereby when the body portion rests against the base juxtaposed the window, a channel space is formed between the support portion and the surrounding wall for retaining the thermal printer mechanism therein.

2. The tear bar of claim 1, wherein the retaining device includes a tab extending from a top side of the support portion towards the body portion.

3. The tear bar of claim 2, wherein the retaining device includes a grip extending at a third angle from the top side of the support portion.

4. The tear bar of claim 1, wherein the second angle is approximately 90 degrees.

5. The tear bar of claim 1, wherein the tear bar is an integral piece made of resilient materials .

6. The tear bar of claim 5, wherein the tear bar is made of metallic materials by stamping.

7. The tear bar of claim 1, wherein the tear portion is formed with continuous, serrated teeth.

8. The tear bar of claim 1, further comprising a grounding tail extending from the body portion.

9. A tear bar for a thermo printer mechanism comprising:

a body portion having a first longitudinal edge and a second longitudinal edge opposing the first longitudinal edge;

a support portion extending along the second longitudinal edge at an angle with respect to the body portion, said body portion and support portions having a substantially L-shape; and a tear portion extending along the first longitudinal edge of the body portion.

10. A tear bar for a thermo printer mechanism, the thermo printer mechanism including at least a thermo head, that is housed in a device housing defining an interior space with a base and surrounding walls and being formed with the window next to one of the surrounding walls, the tear bar comprising:

a body portion having a first longitudinal edge and a second longitudinal edge opposing the first longitudinal edge;

a tear portion extending along the first longitudinal edge at a first angle with respect to the body portion;

a support portion extending along the second longitudinal edge at a second angle with respect to the body portion in a direction substantially opposing the tear portion;

whereby said body portion, tear portion and support portion combined to form a substantially Z-shape.

* * * * *